US008604724B2

(12) United States Patent
Nishikimi

(10) Patent No.: US 8,604,724 B2
(45) Date of Patent: Dec. 10, 2013

(54) VARIABLE SPEED SWITCH

(75) Inventor: Junichi Nishikimi, Anjo (JP)

(73) Assignee: Makita Corporation, Anjo (JP)

( * ) Notice: Subject to any disclaimer, the term of this patent is extended or adjusted under 35 U.S.C. 154(b) by 559 days.

(21) Appl. No.: 12/872,167

(22) Filed: Aug. 31, 2010

(65) Prior Publication Data

US 2011/0057584 A1 Mar. 10, 2011

(30) Foreign Application Priority Data

Sep. 4, 2009 (JP) ..... 2009-204734

(51) Int. Cl.
*B25F 5/00* (2006.01)
*H02K 7/14* (2006.01)
*H01C 10/50* (2006.01)

(52) U.S. Cl.
USPC ..... 318/17; 318/504; 318/538; 388/937

(58) Field of Classification Search
USPC ..... 388/917, 937; 318/244–252, 268, 479, 318/504, 538, 17
See application file for complete search history.

(56) References Cited

U.S. PATENT DOCUMENTS

| | | | | |
|---|---|---|---|---|
| 3,327,196 | A | 6/1967 | Sahrbacker et al. | |
| 3,389,365 | A * | 6/1968 | Matthews et al. | 338/200 |
| 3,611,095 | A * | 10/1971 | Schnizler | 388/838 |
| 3,639,822 | A * | 2/1972 | Brown et al. | 388/830 |
| 3,660,742 | A | 5/1972 | Gawron | |

FOREIGN PATENT DOCUMENTS

| | | |
|---|---|---|
| EP | 1 903 588 A1 | 3/2008 |
| JP | A-7-220563 | 8/1995 |

OTHER PUBLICATIONS

European Search Report for corresponding European Patent Application No. 10009194.1, mailed on Feb. 2, 2011.

* cited by examiner

*Primary Examiner* — Bentsu Ro
(74) *Attorney, Agent, or Firm* — Oliff & Berridge, PLC

(57) ABSTRACT

A switch for controlling a rotational speed of a motor includes an operation member, a first circuit, and a second circuit. The first circuit includes a brush coupled to the operation member having a contact and also includes a variable resistive plate having a resistance that changes in response to a contact position of the contact point of the brush, so that the first circuit outputs a control signal to the motor according to the contact position of the contact point. The second circuit connects the brush and the resistive plate without through the contact point when the brush is positioned at a given position relative to the resistive plate.

12 Claims, 7 Drawing Sheets

VARIABLE SPEED SWITCH

This application claims priority to Japanese patent application serial number 2009-204734, the contents of which are incorporated herein by reference.

BACKGROUND OF THE INVENTION

1. Field of the Invention

The present invention relates to a variable speed switch for adjusting a rotational speed of an electric power tool, which includes a resistive plate and a brush that slides in a given direction with respect to the resistive plate by a pull operation of a trigger, and in which resistance of the resistive plate varies according to the slide of the brush with respect to the resistive plate.

2. Description of the Related Art

An example of this kind of variable speed switches is shown in FIG. 7(A).

The variable speed switch 100 includes a substrate 101, a brush 107 that slides in an arrowed direction (horizontal direction) with respect to the substrate 101, and a trigger (not shown) to which the brush 107 is attached, A conductor part 103 and a printed circuit resistor 105 are formed on the surface of the substrate 101 extending horizontally. A far left side and a far right side of the printed circuit resistor 105 are connected to terminals T0 and T1, respectively, and the conductor part 103 is connected to a terminal T2. Further, the far left part and the far right part of the brush 107 can be slidably contacted to the conductor part 103 and the printed circuit resistor 105, respectively.

When the trigger is pulled in the variable speed switch 100, the brush 107 slides from the far left side in a rightward direction according to pulling amount of the trigger and the resistance between the terminals T1 and T2 (the resistance of the variable speed switch 100) decreases gradually. FIG. 7(A) shows a state in which the trigger is pulled to the maximum position. FIG. 7(B) shows an equivalent circuit of the variable speed switch 100.

FIG. 8 is a schematic showing an electric circuit of the electric power tool equipped with the above-described variable speed switch 100. A reference voltage from a controller 102 is applied between the terminals T0 and T1 of the printed circuit resistor 105 in the variable speed switch 100. Consequently, a voltage signal outputted from the terminal T2 drops as the resistance of the variable speed switch 100 decreases. A controller 102 of the electric power tool controls a switching element FET such that a current flowing through a motor M increases according to a drop of the voltage signal outputted from the variable speed switch 100. Thus, a rotational speed of the electric power tool increases by the pull operation of the trigger in the variable speed switch 100.

However, because the above-described variable speed switch 100 is constructed such that resistance varies by sliding the brush 107 with respect to the substrate 101, a contact between the brush 107 and the substrate 101 becomes unstable when the brush 107 etc. becomes worn with time, and the resistance varies unstably when the trigger is pulled as illustrated in FIG. 7(C). Especially, when the resistance fluctuates unstably at the time of the trigger being pulled to the maximum position (refer to the arrow R of FIG. 7(C)), the maximum output (the maximum rotational speed) of the electric power tool fluctuates (refer to the arrow N of FIG. 7(D)), which may deteriorate work efficiency.

To improve this defect, a configuration of electric circuit is used in which a mechanical contact 103 is provided in parallel with the switching element FET, and the mechanical contact 103 is switched ON when the trigger is pulled to the maximum position. Consequently, the maximum output of the electric power tool may not drop and deterioration in the work efficiency may be reduced. However, in this modification, even if the controller 102 controls motor current by sensing a signal showing a drop of a battery voltage 104, the controller 102 cannot prevent over-discharge of the battery 104. This is because motor current flows regardless of a discharge control signal from the controller 102 when the trigger is pulled to the maximum position.

In a variable speed switch described in Japanese Laid-Open Patent Publication No. 7-220563, a rotational speed of the electric tool can be adjusted according to a pressure force applied to a pressure sensor attached to the trigger, which may solve the above described problem.

However, a configuration in which the pressure sensor is attached to the trigger of the variable speed switch may cause a large cost increase.

Thus, there is a need in the art to obtain a rotational stability at low cost and to prevent over-discharge of the battery when an electric power tool is operated at a full speed, without modifying a configuration for sliding a brush with respect to the resistive plate.

SUMMARY OF THE INVENTION

A switch for controlling a rotational speed of a motor includes an operation member, a first circuit, and a second circuit. The first circuit includes a brush coupled to the operation member having a contact and also includes a variable resistive plate having a resistance that changes in response to a contact position of the contact point of the brush, so that the first circuit outputs a control signal to the motor according to the contact position of the contact point. The second circuit connects the brush and the resistive plate without through the contact point when the brush is positioned at a given position relative to the resistive plate.

BRIEF DESCRIPTION OF THE DRAWINGS

FIG. 2 (B) is a schematic view showing a variable speed switch in which a trigger returns to the original position.

FIG. 2 (C) is a schematic view showing a variable speed switch in which a trigger is pulled to the maximum position.

FIG. 3 (B) is a schematic view showing the relationship between pulling amount of the trigger and rotational speed of the electric power tool.

FIG. 4 (B) is a schematic view showing the relationship between pulling amount of the trigger and the resistance of the variable speed switch.

FIG. 4 (C) is a schematic view showing the relationship between pulling amount of the trigger and rotational speed of the electric power tool.

FIG. 7 (B) is a schematic view showing an equivalent circuit of the variable speed switch.

FIG. 7 (C) is a schematic view showing the relationship between pulling amount of the trigger and the resistance of the variable speed switch.

FIG. 7 (D) is a schematic view showing the relationship between pulling amount of the trigger and rotational speed of the electric power tool.

DETAILED DESCRIPTION OF THE INVENTION

Figure 1:
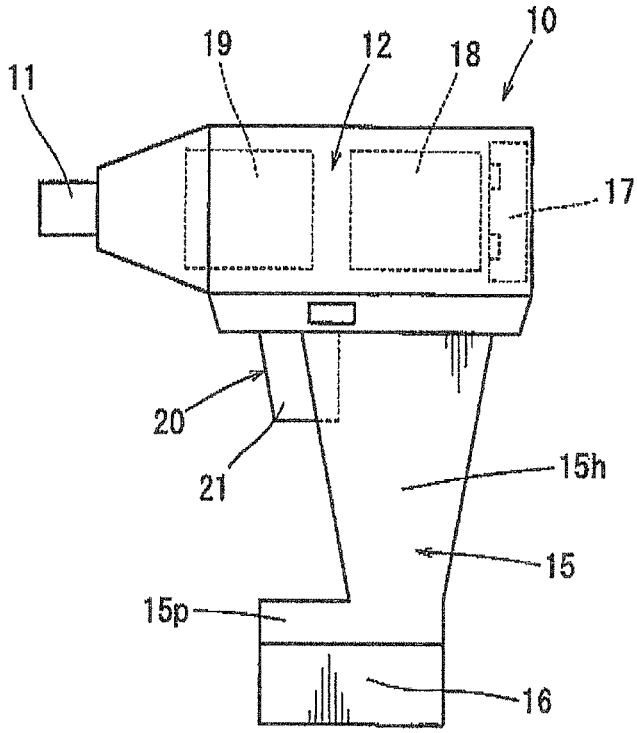
FIG. 1 is a schematically lateral view of the electric power tool equipped with a variable speed switch according to an example of the present invention.

Each of the additional features and teachings disclosed above and below may be utilized separately or in conjunction with other features and teachings to provide improved variable speed switch. Representative examples of the present teaching, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

One construction for a switch for adjusting a rotational speed of an electric power tool can include a resistive plate and a brush for sliding in a given direction with respect to the resistive plate by a pull operation of a trigger. The switch is a variable speed switch in which the resistance varies by sliding the brush with respect to the resistive plate. The resistance varies according to a sliding position of the brush with respect to the resistive plate. And the switch can include a main switch-circuit and a subsidiary switch-circuit for outputting a signal. The main switch-circuit is constructed such that a signal voltage is outputted from a terminal of the brush in a state of a reference voltage being applied between a terminal of a brush-sliding-start side in the resistive plate and a terminal of a brush-sliding-end side in the resistive plate, and the subsidiary switch-circuit is constructed such that the terminal of the brush-sliding-end side is electrically connected to the terminal of the brush when the trigger is pulled to the given position.

According to this construction, when the trigger is pulled to the given position, the terminal of the brush-sliding-end side in the resistive plate is electrically connected to the terminal of the brush via the subsidiary switch-circuit.

For example, when the trigger is pulled to the given position and then the terminal of the brush-sliding-end side in the resistive plate and the terminal of the brush are connected via the subsidiary switch-circuit, a signal voltage of the terminal of the brush becomes equal to the terminal voltage at the terminal of the brush-sliding-end side in the resistive plate. Further, when the terminal of the brush-sliding-end side in the resistive plate and the terminal of the brush are connected by a constant resistance via the subsidiary switch-circuit, a signal voltage at the terminal of the brush is proportional to a terminal voltage at the terminal of the brush-sliding-end side in the resistive plate.

Consequently, even if the resistance of the main switch-circuit fluctuates unstably because of wear of the brush or the resistive plate over time, a signal voltage at the terminal of the brush becomes constant when the trigger is pulled to the given position. Thus, when the trigger is pulled to the given position, a rotational speed of the electric power tool cannot be unstable and the working activity cannot be deteriorated by using The electric power tool in this condition.

Most cases, the electric power tool may be used in a state in which the trigger is pulled to the maximum position (a setting position where the maximum rotational speed can be provided). Therefore, there arises little problem if a rotational speed of the electric power tool becomes unstable during the process of the trigger being pulled to the maximum position, and thus, in many cases, a state in which the trigger is pulled to the maximum position is set as a given position.

A state in which the trigger is pulled to the maximum position is a state in which a signal voltage equals to a voltage produced when the trigger is pulled to the limit position and includes a state in which the trigger is pulled to the vicinity of the limit position.

In this way, because a configuration that includes the resistive plate and the brush can be used with little modification, a rotational stability of the electric power tool can be obtained at a low cost. Further, since there is no need to provide a mechanical contact parallel to a switching element in the electrical circuit, over-discharge of the battery can be prevented.

According to another construction, the subsidiary switch-circuit can include a mechanical contact that connects the terminal of the brush-sliding-end side in the resistive plate and the terminal of the brush.

According to another construction, the subsidiary switch-circuit can include a brush that can slide together with the trigger in a given direction and a conductor to which the brush is connected when the trigger is pulled to the given position, and the mechanical contact is formed between the brush and the conductor.

Thus, it is ensured that when the trigger is pulled to the given position, the mechanical contact in the subsidiary switch-circuit can be switched ON.

According to another construction, the subsidiary switch-circuit can include a semiconductor switch and is configured such that the semiconductor switch becomes conductive when the trigger is pulled to the given position.

Thus, durability of the subsidiary switch-circuit can be improved.

According to the above, a rotational stability when the electric power tool rotates at the full speed can be obtained at the low cost. Further, over-discharge of the battery can be prevented.

A variable speed switch according to an example, which is a trigger-type operational switch used in an impact driver (hereinafter termed an electric power tool), will be described below with reference to FIG. 1 to FIG. 6.

The electric power tool will be briefly explained below before the variable speed switch is explained.

An electric power tool 10 according to an example includes a tubular housing main body 12 and a grip part 15 protruding from a lateral part of the housing main body 12 (a lower part in FIG. 1) as shown in FIG. 1.

A motor 18 is accommodated at a rear part of the housing main body 12, and a driving mechanism 19 for increasing a rotational power of the motor 18 and for transmitting the power to an end tool 11 is accommodated in front of the motor 18. Further, a circuit board 17 is mounted at the rear side of the motor 18, and a switching element FET and a controller 32 for controlling the switching FET are mounted on the circuit substrate 17 (refer to FIG. 2(A)).

The grip part 15 includes a holding part 15*h* that can be held by a user when he or she operates the electric power tool 10 and also includes a lower part 15*p* that is located below the holding part 15*h* (an end side). A trigger-type variable speed switch 20, which is operated when a user pulls the trigger, is provided at an end part of the holding part 15*h*. Further, a coupling mechanism (not shown) that couples the grip part 15 to a battery pack 16 is provided at the lower part 15*p* of the grip part 15.

Figure 2A:
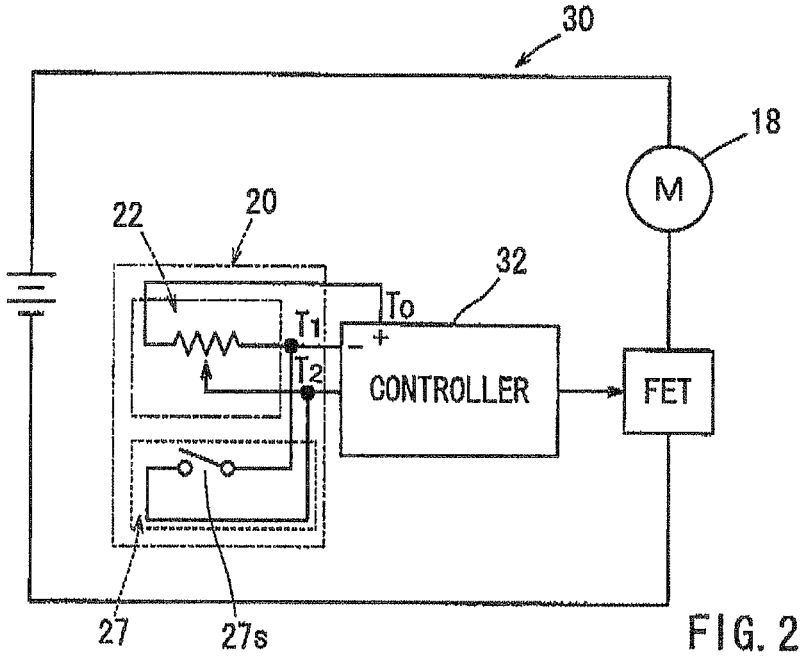
FIG. 2 (A) is a schematic view showing an electrical circuit of the electric power tool.
Figure 2B:
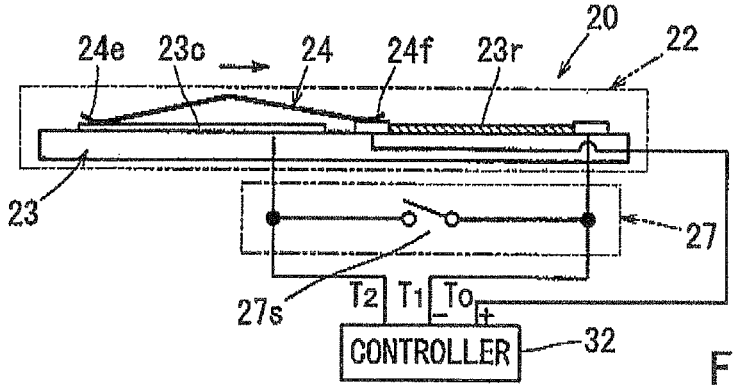
Figure 2C:
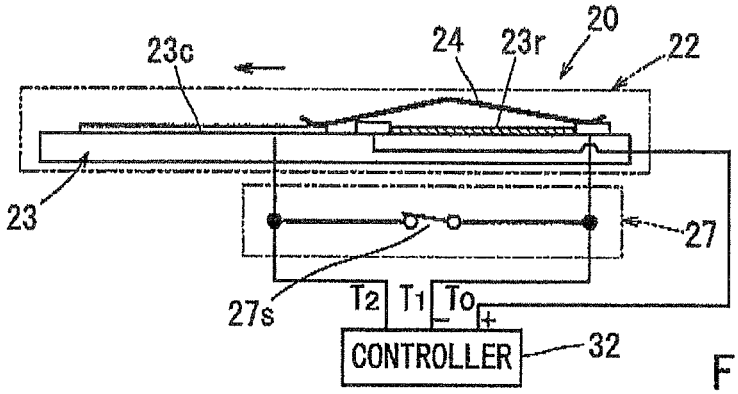

A variable speed switch 20 is for increasing a rotational speed of the electric power tool 10 (a motor 18) according to pulling amount of a trigger 21 and includes a main switch-circuit 22 and a subsidiary switch-circuit 27 for outputting a signal which are connected in parallel, as shown in FIGS. 2(A) to 2(C).

The main switch-circuit 22 includes a substrate 23 and a brush 24 that slides in the arrowed direction (a horizontal direction) with respect to the substrate 23 and moves together with the trigger 21. On a surface of the substrate 23, a conductor part 23*c* and a printed circuit resistor 23*r* are formed extending in the sliding direction of the brush 24 (a horizontal direction). One end (a left end) of the printed circuit resistor 23*r* is connected to a terminal T0, another end (a right end) is connected to a terminal T1, and the conductor part 23*c* is connected to a terminal T2. Further, a left-end sliding part 24*e* of the brush 24 can be contacted to the conductor part 23*c* and a right-end sliding part 24*f* of the brush 24 can be contacted to the printed circuit resistor 23*r*. Thus, when the trigger 21 of the variable speed switch 20 is pulled, the brush 24 slides in the right direction from a left end position shown in FIG. 2(B) according to pulling amount of the trigger 21 and the resistance of the main switch-circuit 22 decreases gradually. Finally, when the trigger 21 is pulled to the maximum position and then the brush 24 reaches the right end position as shown in FIG. 2(C), the resistance of the main switch-circuit 22 becomes zero.

Namely, the substrate 23 that includes both the conductor part 23*c* and the printed circuit resistor 23*r* corresponds to a resistive plate of the present invention. And the terminal T0 that is one end (a left end) of the printed circuit resistor 23*r* corresponds to a terminal of a brush-sliding-start side in the resistive plate of the present invention, and the terminal T1 that is another end (a right end) of the printed circuit resistor 23*r* corresponds to a terminal of a brush-sliding-end side in the resistive plate of the present invention. Further, the terminal T2 connected to the brush 24 via the conductor part 23*c* corresponds to a terminal of the brush of the present invention.

The subsidiary switch-circuit 27 includes a mechanical contact 27*s*. One end side of the mechanical contact 27*s* is connected to the terminal T1 and the other end side is connected to the terminal T2. The mechanical switch 27*s* is constructed such that it is switched ON when the trigger 21 is pulled to the maximum position (refer to FIG. 2(C)) and is switched OFF otherwise. Thus, during the process of the trigger 21 being pulled from the minimum position to nearly the maximum position, the mechanical contact 27*s* of the subsidiary switch-circuit 27 is switched OFF and the resistance of the main switch-circuit 22 emerges between the terminals T1 and T2. When the trigger 21 is pulled to the maximum position, the mechanical contact 27*s* of the subsidiary switch-circuit 27 is switched ON and the resistance between the terminals T1 and T2 becomes zero. Namely, the terminal Ti of the brush-sliding-end side in the printed circuit resistor 23*r* and the terminal T2 of the brush 24 in the main switch-circuit 22 are short-circuited.

As shown in FIG. 2(A), an electric circuit 30 of an electric power tool 10 includes a switching element FET for controlling a current supplied to a motor 18 and a controller 32 for controlling the switching FET according to a signal from a variable switch 20. The controller 32 is constructed such that it can apply a reference voltage between the terminals T0 and T1 of the printed circuit resistor 23*r* in the variable speed switch 20 (the main switch-circuit 22). Therefore, as the resistance between the terminal T1 of the main switch-circuit 22 and the terminal T2 (the terminal T2 of the brush 24) decreases, a voltage signal outputted from the terminal T2 of the brush 24 drops. The controller 32 controls the switching element FET so that a current supplied to the motor 18 increases according to a drop of the voltage signal of the variable speed switch 20 (the voltage signal of the terminal T2). As described above, the variable speed switch 20 (the main switch-circuit 22) is constructed such that the resistance decreases according to pulling amount of the trigger 21, and thus pulling the trigger 21 can increase a rotational speed of the electric power tool 10 via the controller 32.

Figure 3A:
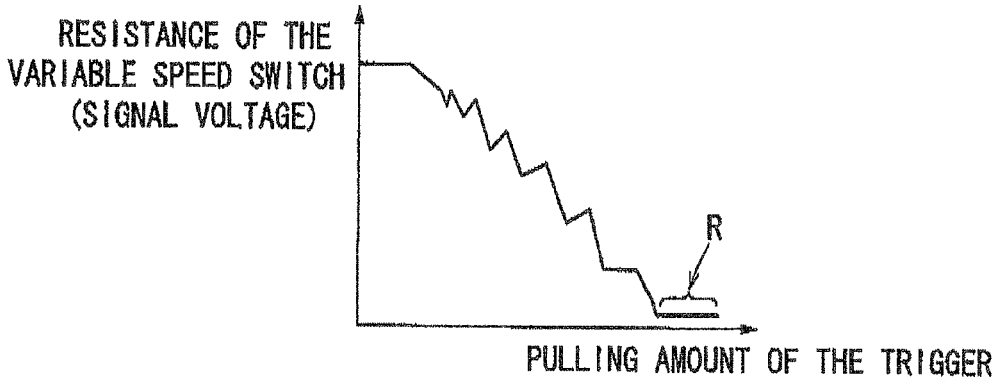
FIG. 3 (A) is a schematic view showing the relationship between pulling amount of the trigger and the resistance of the variable speed switch.
Figure 3B:
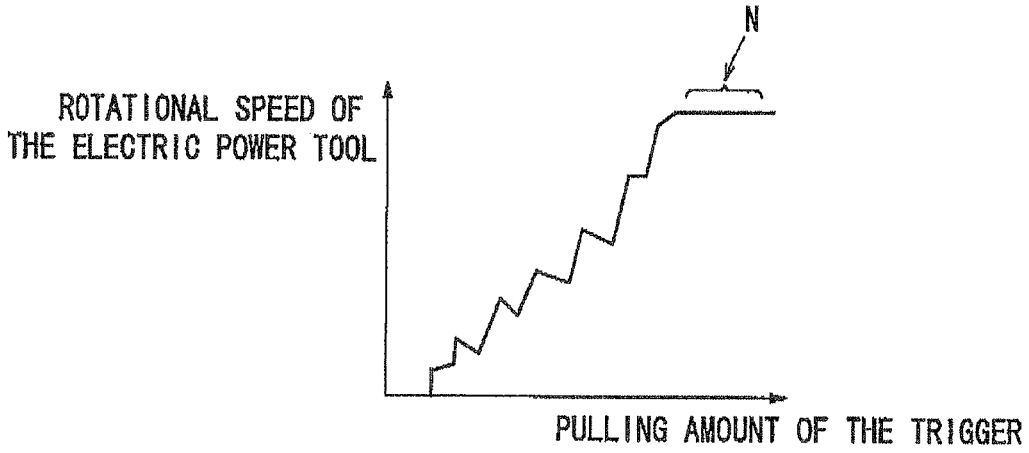

In the above-described variable speed switch 20, when the trigger 21 is pulled to the maximum position, the terminal T1 of the brush-sliding-end side in the printed circuit resistor 23*r* of the main switch-circuit 22 and the terminal T2 of the brush 24 are electrically connected via the subsidiary switch-circuit 27. Namely, the terminal T1 of the brush-sliding-end side in the printed circuit resistor 23*r* of the main switch-circuit 22 and the terminal T2 of the brush 24 are short-circuited. Consequently, a signal voltage of the terminal T2 of the brush 24 becomes equal to a terminal voltage of the terminal T1 of the brush-sliding-end side in the printed circuit resistor 23*r* of the main switch-circuit 22. Therefore, even if the resistance of the main switch-circuit 22 (a signal voltage of the terminal T2) fluctuates unstably as shown in FIG. 3(A) because the brush 24 or the printed circuit resistor 23*r* wears over time, a signal voltage of the terminal T2 of the brush 24 becomes constant when the trigger 21 is pulled to a given position (refer to the R part of FIG. 3(A)). Thus, as shown in the arrowed N of FIG. 3(B), a rotational speed (the maximum speed) of the electric power tool cannot be unstable when the trigger 21 is pulled to the maximum position, and working activity can be prevented from deteriorating by using the electric power tool in this condition. Most cases, the electric power tool can be used in a state in which the trigger 21 is pulled to the maximum position, and thus there arises little problem even if a rotational speed becomes unstable during the process of the trigger 21 being moved to the given position.

As described above, a rotational stability of the electric power tool 10 can be obtained at the low cost, because the substrate 23 and the brush 24 which are included in the main switch-circuit 22 can be used with little modification.

The above construction may not be limited by the above-described example and various changes may be made without departing from the scope of the invention. For example, the above example shows that the electric power tool 10 includes the variable speed switch 20 that is constructed such that the resistance decreases according to pulling amount of the trigger 21. However, as shown in FIG. 4(B), the above construction can be applied to electric power tools in which the variable speed switch 20, which is constructed such that the resistance (a signal voltage) increases according to pulling amount of the trigger 21, is used.

Figure 4A:
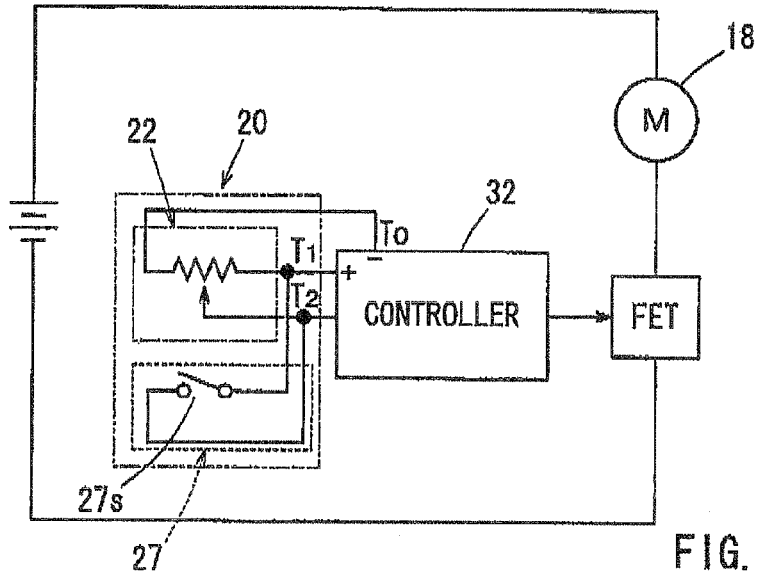
FIG. 4 (A) is a schematic view showing an electrical circuit of the power tool equipped with a variable speed switch according to a modified example.
Figure 4B:
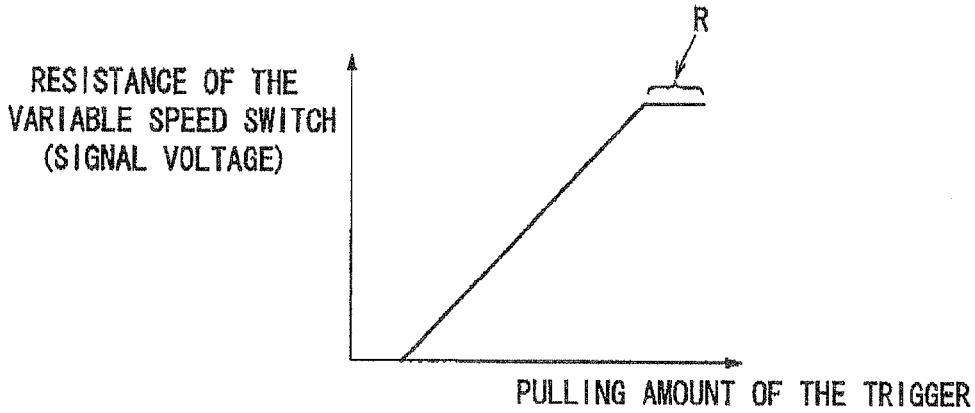
Figure 4C:
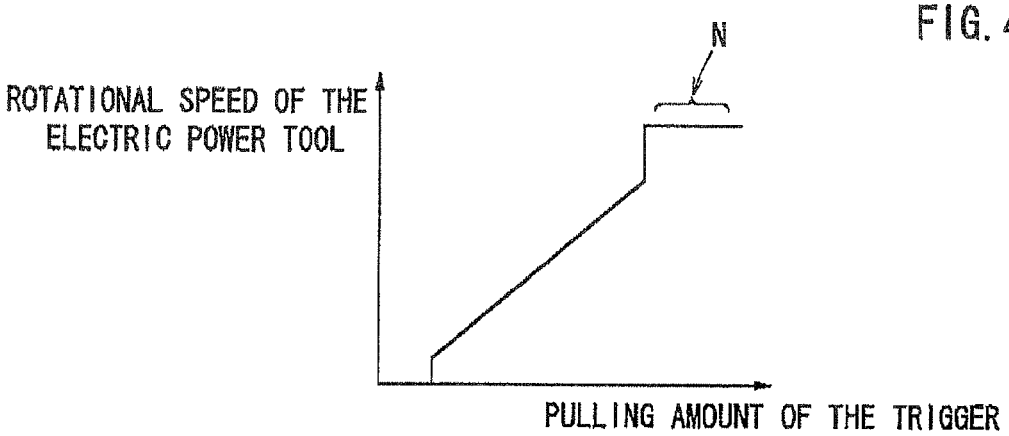

In this case, as shown in FIG. 4(A), the variable speed switch 20 is constructed such that the terminal T0 and the terminal T1 are connected to a negative side and a positive side of the controller 32, respectively, and the reference voltage is applied between the terminals T0 and T1. Consequently, the voltage signal outputted from the terminal T2 of the brush 24 increases according to pulling amount of the trigger 21. The controller 32 controls the switching FET such that a current supplied to the motor 18 increases according to an increase of the voltage signal of the variable speed switch 20 (the voltage signal of the terminal T2).

The subsidiary switch-circuit 27 includes the mechanical contact 27*s*, and one end of the mechanical contact 27*s* is connected to the terminal T1 and the other end is connected to the terminal T2.

Consequently, even if the resistance of the main switch-circuit 22 fluctuates unstably owing to wear of the brush 24 or the printed circuit resistor 23*r* over time, the mechanical contact 27*s* of the subsidiary switch-circuit 27 is switched ON when the trigger 21 is pulled to the maximum position and the signal voltage of the terminal T2 of the brush 24 becomes constant when the trigger is pulled to the given position of the trigger 21. Therefore, as shown in the arrow N of FIG. 4(C), a rotational speed of the electric power tool at the time of the trigger 21 being pulled to the maximum position becomes stable and the working activity cannot be deteriorated.

Figure 5:
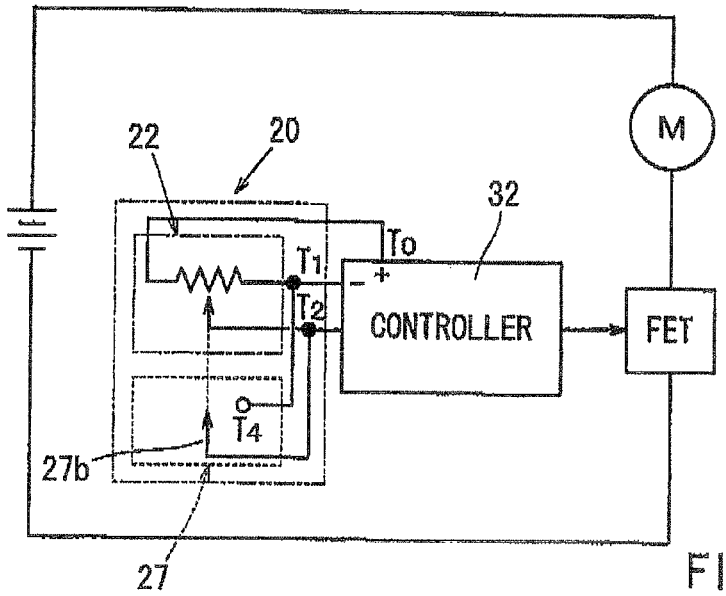
FIG. 5 is a schematic view showing an electrical circuit of the power tool equipped with a variable speed switch according to a modified example.

Instead of the mechanical contact 27*s* of the subsidiary switch-circuit 27 in FIG. 4(A), it is possible to construct such that a brush 27*b* that moves together with the trigger 21 is provided and one end of the brush 27*b* is connected to the terminal T4 when the trigger 21 is pulled to the maximum position, as shown in FIG. 5.

Figure 6:
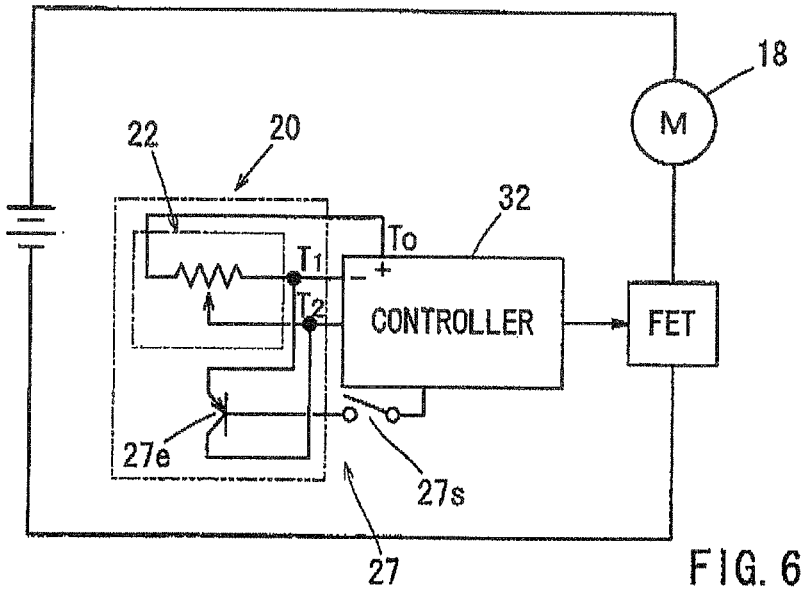
FIG. 6 is a schematic view showing an electrical circuit of the power tool equipped with a variable speed switch according to a modified example.
Figure 7A:
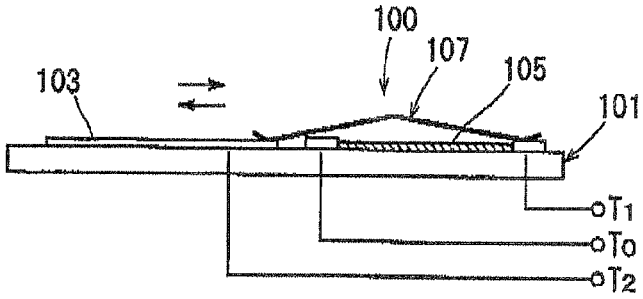
FIG. 7(A) PRIOR ART
FIG. 7 (A) is a schematic view showing a known variable speed switch in which the trigger is pulled to the maximum position.
Figure 7B:
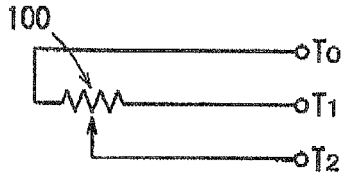
FIG. 7(B) PRIOR ART
Figure 7C:
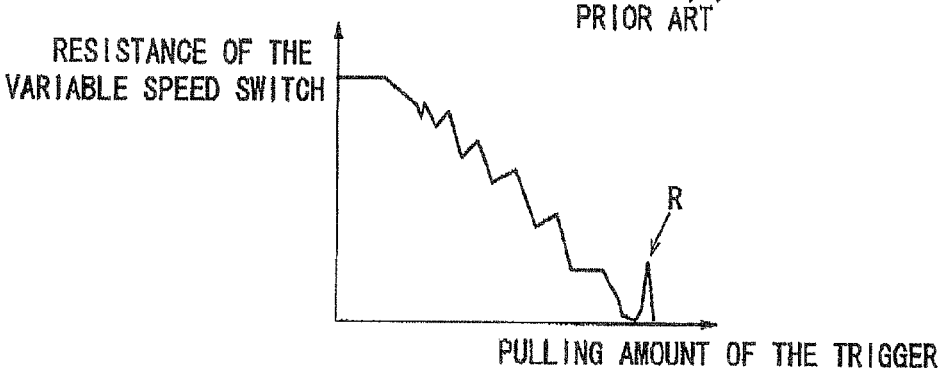
FIG. 7(C) PRIOR ART
Figure 7D:
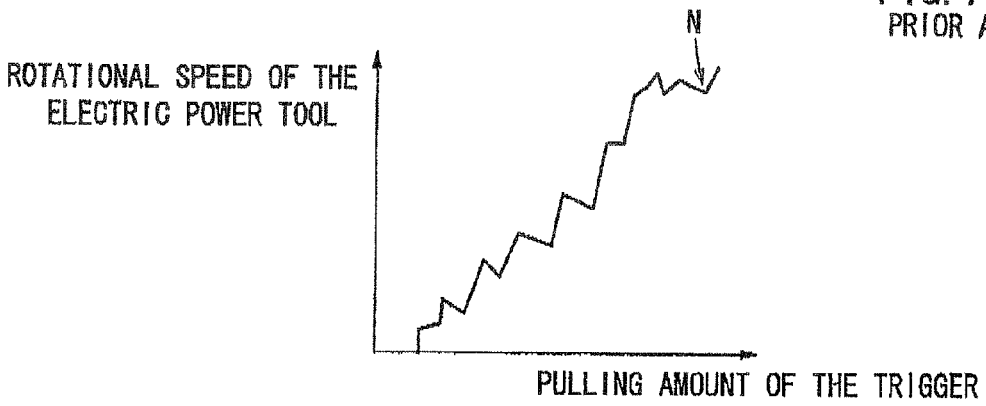
FIG. 7(D) PRIOR ART
Figure 8:
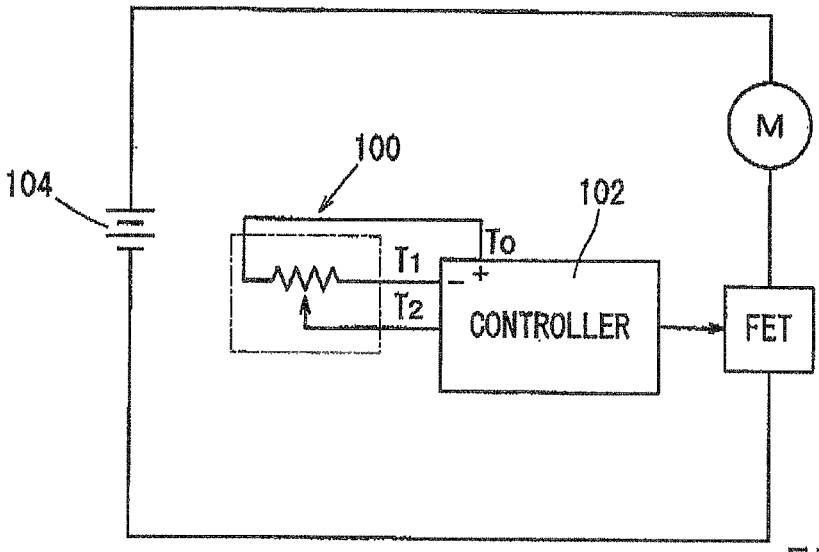
FIG. 8 PRIOR ART
FIG. 8 is a schematic view showing an electrical circuit of a known electric power tool.
Figure 9:
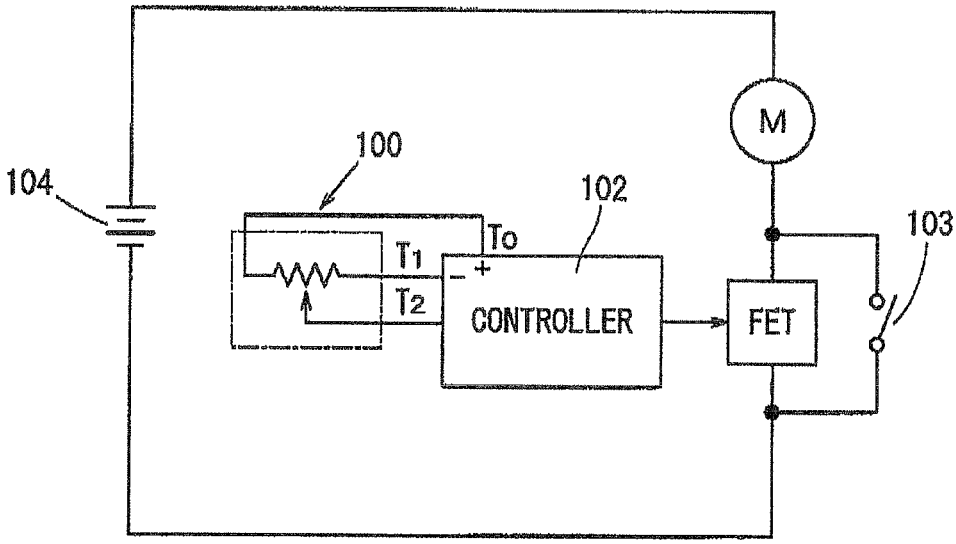
FIG. 9 PRIOR ART
FIG. 9 is a schematic view showing an electrical circuit of a known electric power tool.

Further, as shown in FIG. 6, it is possible to construct such that the subsidiary switch-circuit 27 includes the contact 27*s* and a semiconductor switch 27*e*.

Further, the example shows that the subsidiary switch-circuit 27 is switched ON when the trigger 21 is pulled to the maximum position, but it is possible to construct such that the subsidiary switch-circuit 27 is switched ON when the trigger 21 is pulled to the given position.

Further, the example shows that the subsidiary switch-circuit 27 is included inside the variable speed switch 20, but it is possible to construct such that the subsidiary switch-circuit 27 is provided outside the variable speed switch 20. It is also possible to include the subsidiary switch-circuit 27 and the controller 32 inside the variable speed switch 20.

I claim:

1. A variable speed switch for adjusting a rotational speed of an electric power tool, comprising:

a trigger configured to be pulled by a user;

a resistive plate;

a brush that can be slid in a given direction with respect to the resistive plate by a pull operation of the trigger of the electric power tool;

a main switch-circuit;

a subsidiary switch-circuit; and a controller for controlling the rotational speed of the electric power tool, wherein:

resistance of the resistive plate changes according to a sliding position of the brush with respect to the resistive plate;

in the main switch-circuit, a signal voltage is outputted from a terminal of the brush when a reference voltage is applied between a terminal of a brush-sliding-start side in the resistive plate and a terminal of a brush-sliding-end side in the resistive plate;

in the subsidiary switch-circuit, the terminal of the brush-sliding-end side in the resistive plate and a terminal of the brush are electrically connected when the trigger is pulled to a given position; and the controller is configured to apply the reference voltage and to control the rotational speed of the electric power tool according to the signal voltage outputted from the terminal of the brush.

2. The variable speed switch as in claim 1, wherein the subsidiary switch-circuit includes a mechanically operable electric contact device that is constructed such that the terminal of the brush-sliding-end side in the resistive plate and the terminal of the brush can be short-circuited.

3. The variable speed switch as in claim 2, wherein:

the subsidiary switch-circuit includes a second brush that slides with the trigger in a given direction and further includes a conductor that can be connected to the brush when the trigger of the electric power tool is pulled to the given position; and the mechanical contact is formed between the brush and the conductor.

4. The variable speed switch as in claim 2, wherein the subsidiary switch-circuit includes a semiconductor switch that is constructed to become conductive when the trigger is pulled to the given position.

5. The variable speed switch as in claim 1, wherein the given position is a maximum position to which the brush can slide with respect to the resistive plate.

6. The variable speed switch as in claim 1, wherein the given position is located in proximity to the maximum position to which the brush can slide with respect to the resistive plate.

7. The variable speed switch as in claim 1, wherein the resistance of the resistive plate decreases as the brush slides in a given direction with respect to the resistive plate.

8. The variable speed switch as in claim 1, wherein the resistance of the resistive plate increases as the brush slides in a given direction with respect to the resistive plate.

9. The variable speed switch as in claim 1, wherein the subsidiary switch-circuit is arranged outside the variable speed switch.

10. The variable speed switch as in claim 1, wherein the controller controls the rotational speed of the electric power tool via a switching element.

11. The variable speed switch as in claim 10, wherein the controller controls the rotational speed of the electric power tool according to a battery voltage of the electric power tool.

12. An electric power tool comprising the variable speed switch as in claim 1.

* * * * *